United States Patent [19]

Keritsis et al.

[11] Patent Number: 4,936,920

[45] Date of Patent: Jun. 26, 1990

[54] HIGH VOID VOLUME/ENHANCED FIRMNESS TOBACCO ROD AND METHOD OF PROCESSING TOBACCO

[75] Inventors: Gus D. Keritsis, Richmond; Robert S. Mullins, Manakin-Sabot; Jose G. Nepomuceno; Lewis A. Haws, both of Richmond, all of Va.; Harry A. Jones, Boynton Beach, Fla.; Veronica Y. Manuel, Highland Springs; Wesley G. Sanderson, both of Richmond, Va.; John F. Sherwood; Warren D. Winterson, both of Midlothian, Va.

[73] Assignee: Philip Morris Incorporated, New York, N.Y.

[21] Appl. No.: 166,005

[22] Filed: Mar. 9, 1988

[51] Int. Cl.[5] ..... A24C 5/00; A24C 5/14

[52] U.S. Cl. ..... 131/77; 131/78; 131/79; 131/84.1; 131/352; 131/364; 493/43; 493/49

[58] Field of Search ..... 131/355, 359, 369, 364, 131/77, 78, 79, 84.1, 364, 352, 39, 42, 43, 44, 49

[56] References Cited

U.S. PATENT DOCUMENTS

| | | |
|---|---|---|
| 61,275 | 0/1867 | Stayman . |
| 64,591 | 0/1867 | Stayman . |
| 236,510 | 0/1881 | Pacholder . |
| 1,961,866 | 6/1931 | Rooker . |
| 2,114,281 | 4/1938 | Allen . |
| 2,149,869 | 3/1939 | McArdle . |
| 2,185,293 | 1/1940 | Copeman . |
| 2,190,107 | 2/1940 | Pohle . |
| 2,217,527 | 10/1940 | Roon . |
| 2,307,088 | 1/1943 | Whiteley . |
| 2,349,551 | 5/1944 | Helm . |
| 2,592,554 | 4/1952 | Frankeburg . |
| 2,734,509 | 2/1956 | Jurgensen . |
| 2,739,600 | 3/1956 | Staib . |
| 2,769,734 | 11/1956 | Bandel . |
| 2,845,933 | 8/1958 | Samfield . |
| 3,012,915 | 12/1961 | Howard . |
| 3,046,996 | 7/1962 | Gary . |
| 3,053,259 | 9/1962 | Parmele . |
| 3,096,772 | 7/1963 | Korber . |
| 3,136,321 | 6/1964 | Davis . |
| 3,209,763 | 10/1965 | Parmele . |
| 3,318,317 | 5/1967 | Sproull . |
| 3,353,543 | 11/1967 | Sproull . |
| 3,364,935 | 1/1968 | Moshy . |
| 3,386,540 | 6/1968 | Seligman . |
| 3,402,722 | 9/1968 | Kochalski . |
| 3,404,690 | 10/1968 | Moshy . |
| 3,404,691 | 10/1968 | Moshy . |

(List continued on next page.)

FOREIGN PATENT DOCUMENTS

| | | | |
|---|---|---|---|
| 0067601 | 12/1982 | European Pat. Off. . | |
| 0232166 | 12/1987 | European Pat. Off. . | |
| 1167717 | 4/1964 | Fed. Rep. of Germany . | |
| 0275420 | 8/1951 | Switzerland | 131/77 |
| 1055445 | 1/1967 | United Kingdom . | |
| 1157574 | 7/1969 | United Kingdom . | |
| 1171878 | 11/1969 | United Kingdom . | |
| 1194572 | 6/1970 | United Kingdom . | |
| 1512352 | 6/1978 | United Kingdom . | |
| 1593729 | 6/1981 | United Kingdom . | |
| 2128873 | 5/1984 | United Kingdom . | |

OTHER PUBLICATIONS

"Microwaves Dry Pasta", Food Engineering (Apr. 1972) Schiffman, "The Application of Microwave Power in the Food Industry in the United States", 8 J. Microwave Power 137 (Jun. 1973).

*Primary Examiner*—V. Millin

*Attorney, Agent, or Firm*—Donald E. Degling; Mitchell P. Brook

[57] ABSTRACT

A tobacco product characterized by improved void volume and firmness characteristics and a method of making a tobacco product by applying binder material to tobacco filler, treating the filler to the extent necessary to cause the filler to become substantially non-tacky, forming a rod, activating the binder and treating the rod to the extent necessary to cause the filler shreds to become bonded to one another.

38 Claims, 5 Drawing Sheets

U.S. PATENT DOCUMENTS 3,407,080 11/1968 Rainwater .
3,410,279 11/1968 Moshy .
3,420,241 1/1969 Hind .
3,472,237 10/1969 Stephens .
3,499,454 3/1970 Hind .
3,515,147 6/1970 Sledge .
3,528,434 9/1970 Halter .
3,584,631 6/1971 Halter .
3,732,872 5/1973 Lakritz .
3,773,055 10/1973 Stungis .
3,817,258 6/1974 Enrow .
3,821,959 6/1974 Schmidt .
3,847,162 11/1974 Sell .
4,009,723 3/1977 Stungis .
4,034,764 6/1977 Rainer .
4,144,894 3/1979 Schmidt .
4,210,157 7/1980 Kohnborst .
4,233,993 11/1980 Miano .
4,341,228 7/1982 Keritsis .
4,347,855 9/1982 Lanzillotti .
4,366,826 1/1983 Horsewell .
4,409,995 10/1983 Nichols .
4,452,260 6/1984 Porenski .
4,485,829 12/1984 Rainer .
4,497,331 2/1985 Nellen .
4,542,755 9/1985 Selke .
4,574,819 3/1986 Rainer .
4,619,276 10/1986 Albertson .
4,625,737 12/1986 Keritsis .
4,674,519 6/1987 Keritsis .
4,715,388 12/1987 Rainer .

HIGH VOID VOLUME/ENHANCED FIRMNESS TOBACCO ROD AND METHOD OF PROCESSING TOBACCO

BACKGROUND OF THE INVENTION

The present invention relates to tobacco-containing smoking articles, and methods for processing tobacco. More particularly, the present invention relates to a rod of adhesive bound tobacco shreds which may be wrapped to form a cigarette preferably having both relatively large interstitial spaces between tobacco shreds and a firmness level comparable to commercial cigarettes.

For many years, cigarette manufacturers have sought to maximize the desirable characteristics of manufactured tobacco and smoking articles. Among these desirable characteristics have been pleasing taste and aroma, reduced smoke during static burning, ease of draw, reduced shedding of tobacco particles from the rod ends, proper coal integrity and proper firmness and density of the rod. Additionally, manufacturers have long been aware of the advantages of increasing the filing power of tobacco.

DEFINITIONS

As used herein and in the claims that follow, the following terms have the indicated meanings:

"Density": Densities of the sample cigarettes are determined by weighing each individual equilibrated cigarette (equilibrated at a temperature of 75° F. and 60% relative humidity) and then measuring the circumference of each cigarette using a laser micrometer. This allows density to be calculated by dividing the amount of filler in the cigarette (total weight minus the weight of the paper and seam adhesive) by the volume of the cigarette (length$\times$(circumference/$2\pi$)$^2\times\pi$).

"Firmness": Resistance to compression. Firmness is determined by placing 15 cigarettes in 3 levels of 6, 5 and 4 in a holder having a fixed area trapezoidal shaped shoe. The filled cigarette holder is placed under a compression device in such a way that the compression plate is properly placed to make contact with the center 40 mm section of the four cigarettes directly in contact with the plate. The cigarettes are initially compressed with a 100 g plate weight until they stabilize in place. At this time, an additional weight of 1400 g is applied by an electromagnet. At the end of 30 seconds, the compression value measured in mm, which is indicative of cigarette firmness, is automatically recorded. "Increased," "enhanced," or "better" firmness corresponds to less compression and hence lower firmness numbers.

"Void volume" (VV): Percentage of the total volume of a tobacco rod occupied by space between the shreds. Void volume is determined according to the following formula:

$$VV = 100 - \left(\frac{TW \times SV}{RV} \times 100\right)$$

where TW, tobacco weight, is the weight of the filler in grams, SV is the specific volume of the filler in cubic centimeters per gram (cc/g) and RV is the rod volume of the tobacco rod in cubic centimeters. VV is the void volume expressed as the percentage of the rod volume occupied by empty space.

"Specific volume" (SV): The volume of a predetermined amount of tobacco divided by the weight of the tobacco. The SV value is expressed as cc/g. Specific volume of the filler is measured using a mercury specific volume test which involves placing a known weight of a tobacco sample in a sealed chamber of known volume and then evacuating the air in the chamber to a pressure of 1 torr. An amount of mercury is then admitted to the sample chamber in a manner such that the interfacial pressure between the mercury and the tobacco limits the intrusion of mercury into the porous structure. The volume of mercury displaced by the tobacco sample of known weight at an interfacial pressure of 1 to 2 psi absolute is expressed as SV in cc/g. The resulting specific volume value is a measurement of the volume occupied by each gram of tobacco shreds.

"Rod volume" (RV): The volume of the tobacco rod, which equals $\pi$ multiplied by the radius (cm) squared multiplied by the length (cm).

"Interstitial void spaces" and "void spaces": The spaces between the shreds, rather than the spaces that might exist within each shred.

"Tobacco": May include tobacco, expanded tobacco or other materials such as tobacco substitutes, stems or reconstituted tobacco.

"Filler" and "tobacco filler": May include tobacco or other filler material such as tobacco substitutes, stems or reconstituted tobacco which has been cut, shredded, extruded or otherwise prepared for incorporation in a tobacco product.

"Shred": A piece of any cut filler.

"Tobacco rod" and "rod": A rod comprised primarily of tobacco filler as herein defined.

"Cigarette", "tobacco product" and "smoking article": A tobacco rod—which may or may not be intended to be burned—wrapped with a wrapping material such as paper and optionally tipped with a filter.

"Low density rod", "high void volume rod", "enhanced firmness rod" and "high firmness rod": A tobacco rod which when wrapped is characterized by a greater firmness for any given void volume level when compared to a conventional cigarette made from the same type of filler.

"Encapsulated Resistance-to-Draw" and "Resistance-to-Draw" (RTD): RTD is determined as follows. A vacuum system is set to pull an air flow of 1050 cc/minute by inserting a standard capillary tube through the dental dam of a cigarette holder and adjusting the air flow through the capillary tube until the correct reading of the pressure drop across the capillary tube in inches of water, as measured on an inclined water manometer, is obtained. Then the butt end of a tobacco rod, which is wrapped with a paper that is impervious to air, is inserted to a depth of 5 mm in the dental dam of the tobacco rod holder. The pressure drop behind this tobacco rod with 1050 cc/minute of air flowing through is read directly as RTD in inches of water. For the purposes of the present invention, a bonded rod having a low resistance to draw (RTD) is desirable. RTD's not in excess of a value equivalent to 2 inches for a 57 mm length tobacco rod having a circumference of 24.8 mm as measured by the above test are a characteristic of the present invention.

"Binder": May comprise virtually any binding material such as, for example, film forming or cross-linking agents, adhesives, burn additives, casing or flavors effective for the purpose of holding shreds together.

"Radial shred orientation": Orientation of the tobacco shreds within the cigarette such that the longer dimension of the shred is roughly perpendicular to the axis of the cigarette.

"Oven-Volatiles Content" (OV): A unit indicating the moisture content (or percentage of moisture) in tobacco filler. It is determined by weighing a sample of tobacco filler before and after exposure in a circulating air oven for three hours at 100° C. The weight loss as a percentage of initial weight is the oven-volatiles content. The weight loss is attributable to volatiles in addition to water but OV is used interchangeably with moisture content and may be considered equivalent thereto since, at the test conditions, not more than about 1% of the tobacco filler weight is volatiles other than water.

Description Of The Prior Art

The art of manufacturing cigarettes in a high speed cigarette-making machine such as the Mark 8 Cigarette Maker manufactured by the Molins Company is well known. In such a machine, the tobacco filler is introduced into a tobacco chimney and then blown into a perforated vacuum belt. The tobacco filler is then conveyed to an ecreteur or trimmer knife assembly which trims off the excess tobacco filler so that the desired quantity of tobacco filler enters the garniture portion of the machine. Within the garniture portion of the machine, the tobacco filler is formed into a tobacco rod and wrapped in cigarette paper. The wrapped tobacco rod passes through a density gauge and is then cut to length by a rod cut-off mechanism which may be a laser device.

As a result of treating and handling tobacco in its various forms, tobacco dust may be formed. Keritsis et al. U.S. Pat. No. 4,341,228 discloses a method for admixing such dust with a bonding material to form agglomerated particles, admixing the agglomerated particles with a tobacco paste slurry and forming the slurry into a sheet using a paper-making process. The resulting reconstituted tobacco sheet is dried and shredded to form tobacco filler. Keritsis discloses, as bonding materials, film-forming materials, cross-linking agents and calcium-sequestering agents. The tobacco filler formed from the reconstituted tobacco sheets may be blended with natural tobacco filler and fed into the cigarette maker.

The prior art has also found it desirable to add particulate matter in either solid or liquid form to the tobacco filler prior to its entry into the cigarette maker or in the garniture of the maker as shown in Nichols U.S. Pat. No. 4,409,995. Such particulate matter may include flavorings. An advantage of the process of the Nichols patent is that volatile flavorants such as menthol are recovered more completely in the packaged cigarette since less opportunity for vaporization is presented.

More recently, it has become desirable to employ expanded tobacco as a portion of the tobacco filler so that the weight of tobacco in the cigarette could be reduced. In order to compensate for the decreased tobacco content of the cigarette and maintain the firmness or stiffness of the cigarette, the art has suggested applying a bonding agent in liquid form to the tobacco filler by means of a nozzle fed by a pressurized reservoir. British published application 2128873A discloses the use of bonding agents such as collodion in acetone and aqueous solutions of dextrin or sodium caseinate applied to the tobacco filler prior to forming the wrapped tobacco rod.

While the approaches noted above are effective to cause bonding of the shreds or strands of the tobacco filler, they have also raised a number of problems. Thus, where liquid additives are incorporated into the tobacco filler within the garniture portion of the cigarette maker, for example, at the short tongue, the disposition of the additive may be uniform along the length of the tobacco rod but not uniform from side to side of the rod thereby causing streaking of the cigarette wrapper. Also, if the liquid additive is in dilute form, the excess liquid may result in streaking of the cigarette wrapper even when the distribution of the liquid is substantially uniform throughout the tobacco rod. Finally, the use of liquid additives may result in liquid particles adhering to the cigarette maker which may cause it to become gummed up necessitating a shutdown for cleaning.

Albertson et al. U.S. Pat. No. 4,619,276 discloses a method of applying foamed materials to the tobacco filler. The foamed material improves the uniformity of the dispersion of the additive throughout the tobacco and permits the material additions late in the cigarette manufacturing process without causing gumming of the cigarette maker or loss of volatiles. The material which may be foamed includes adhesives, film-forming or cross-linking agents, binders, burn additives, casings or flavors.

SUMMARY OF THE INVENTION

The present invention comprises a method for producing a high void volume/enhanced firmness tobacco rod which may be wrapped to form a cylindrical tobacco product such as a cigarette. This cigarette compares favorably with conventional cigarettes on all of the characteristics mentioned above. The cigarette is characterized by a relatively high firmness despite having a relatively high proportion of its internal volume void of smoking material. It is comprised of shreds of tobacco filler which are adhered to one another by a binder, preferably of a type commonly used as a casing or burn control agent. Suitable binders include pectins, licorice, starches, gums, sugars or honey.

The method includes a first step of applying a solid, liquid or foamed binder to tobacco filler, treating the filler shreds to the extent necessary to cause the binder to become sufficiently non-tacky for storage or processing (such as by drying or dehumidifying) and then activating the binder within the cigarette maker by the use of steam, heat, water, conditioned air or an organic solvent. The binder may also be activated by electromagnetic energy such as microwave, ultrasonic or infra red radiation or by a polymerization process. Where the binder applied to the tobacco filler is dry, the cut tobacco filler should be at a moisture content of about 20% OV to provide enough moisture for the dry material to adhere to the shreds.

It is an object of the present invention to produce a cigarette having pleasing taste, pleasing feel, reduced rod filtration, and reduced shedding of tobacco from the cigarette's tip.

An advantage of the product of the present invention is reduced rod density which results in less tobacco being burned. Similarly, at comparable linear burn rates less sidestream smoke will be generated during static burning. These advantages can be achieved without significant decrease in firmness. An additional advantage of reduced tobacco density is that a longer cigarette can be made with the same amount of tobacco as a shorter, denser cigarette.

A still further advantage is derived from the open lattice of tobacco, in that the tobacco lattice intercepts and holds less smoke than does the more densely packed tobacco of a conventional cigarette, thus minimizing recombustion of materials retained by the tobacco filler.

It may be desirable to control the amount and composition of the smoke by adding a filter to the cigarette. Various known filters, such as cellulose acetate plugs and tobacco plugs, are suitable for this purpose.

The binder has the advantage of tending to prevent loose ends by tending to retain tobacco particles which would otherwise fall from the cigarette ends. Another advantage of the binder is that it may be a material which is already desirably used as a casing or burn control agent. Thus, the additional step of applying the binder may obviate a flavoring step.

BRIEF DESCRIPTION OF THE DRAWINGS

The above and other objects and advantages of the invention will be apparent upon consideration of the following detailed description, taken in conjunction with the accompanying drawings in which like reference characters refer to the like parts throughout and in which.

DETAILED DESCRIPTION OF THE INVENTION

A high void volume cigarette characterized by an enhanced firmness may be formed by binding the filler shreds at points of shred-to-shred contact and by bridges of binder between shreds in close proximity to each other. The processes of the present invention make possible a practical high void volume/ enhanced firmness cigarette.

Firmness of conventional cigarettes is dependent upon the interstitial void volume. Generally, for a given type of filler, where there is a high interstitial void volume, cigarettes are less firm and tend to fall apart when handled. Where there is a low interstitial void volume cigarettes are more firm. For any given void volume, the cigarette of the present invention will exhibit greater firmness. The elevated firmness of the present invention is measurable by comparing the firmness of a conventional cigarette with the firmness of the cigarette of the present invention, while holding other variables constant.

Figure 1:
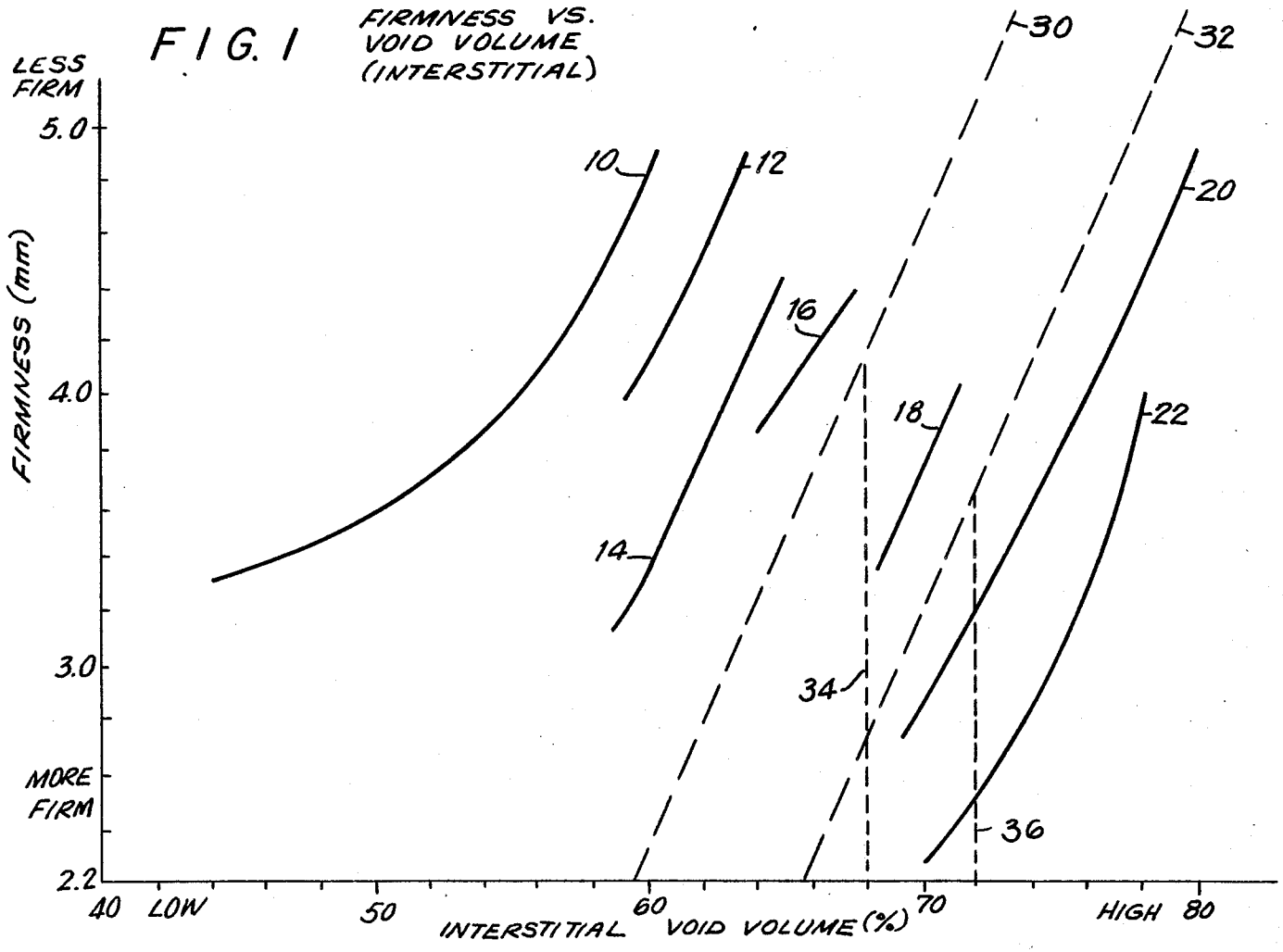
FIG. 1 is a graphic illustration of the relationship between firmness and void volume for both conventional cigarettes and for cigarettes according to the invention.

The relationship between firmness of cigarettes and void volume may be illustrated graphically. FIG. 1 shows empirical measurements of void volume and firmness for cigarettes made from a number of different types of tobacco fillers over a range of densities. The circumference of the cigarettes tested was 24.8 mm, which is the typical cigarette circumference in the cigarette industry. (Empirical results will vary somewhat with the diameter of the cigarette tested.) Line 10 shows the firmness and void volume measurements of cigarettes made from expanded Bright tobacco; Line 12 corresponds to cigarettes made from unexpanded Bright tobacco; Line 14 corresponds to a typical commercial blended cigarette; Line 16 corresponds to a cigarette made from a typical commercial tobacco blend using the foamed binder process disclosed in commonly assigned U.S. Pat. No. 4,619,276 and having a 0.5% binder solids add-on level; Line 18 corresponds to a cigarette made from unexpanded Burley tobacco; Line 20 shows the firmness-void volume relationship for the high void volume/enhanced firmness cigarettes of the present invention (using a typical commercial blend) having a 2% binder solids add-on level; and Line 22 corresponds to a high void volume/enhanced firmness cigarette (same blend) with a 6% binder solids add-on level. It will be understood that "binder solids add-on level" is the percent by weight of binder solids in the final filler product based on filler at a moisture level of 12.5% to 13.2%.

FIG. 1 shows that for each cigarette type, including the high void volume/enhanced firmness cigarettes of the present invention, as void volume increases (and therefore density decreases), the cigarettes become less firm. However, a comparison of Line 14 (conventional filter cigarette) with Lines 20 and 22 (high void volume-/enhanced firmness) shows that for a given firmness, the void volume of a cigarette according to the present invention is significantly higher, i.e., Lines 20 and 22 are to the right of Line 14. Likewise, for any given tobacco filler, the cigarettes of the present invention attain a better firmness for a specified void volume. The high void volume/enhanced firmness cigarette also compares favorably with each of the conventional cigarettes, including the cigarette comprised of 100% Burley (Line 18)—a tobacco known for desirable firmness traits but also known for a harsh and unpalatable taste when smoked in cigarettes having high concentrations of Burley. Thus, FIG. 1 demonstrates that with the exception of a commercially unacceptable 100% Burley cigarette (Line 18), the high void volume/enhanced firmness cigarettes achieve void volume and firmness measurements to the right of Line 30. This high void volume/enhanced firmness region of FIG. 1, derived from empirical data, is represented as follows:

$$VV > \frac{((F \times 10) + 108.4\ \text{mm})}{2.2\ \text{mm}}$$

where VV corresponds to percent void volume and F corresponds to measured firmness.

The ability to achieve an even better relationship between firmness and void volume, as indicated in the region to the right of Line 32, is a further characteristic of the present invention. This region, derived from empirical data, is represented as follows:

$$VV > \frac{((F \times 10) + 123.2\ \text{mm})}{2.2\ \text{mm}}$$

FIG. 1 also demonstrates that with the exception of a commercially unacceptable Burley cigarette (Line 18), the high void volume/enhanced firmness cigarettes achieve void volume measurements exceeding 68% (Line 34) and the amount determined by Line 30. And, only the present invention has void volumes exceeding 72% (Line 36) and the amount determined by Line 32.

The method of the present invention involves applying binder material in dry, foamed or liquid form to tobacco filler for use in manufacturing cigarettes having increased firmness and reduced loose ends and which permits the quantity of tobacco incorporated into the cigarette to be reduced. In order to avoid the problems of nonuniform dispersion and gumming up of the machine the step of applying the binder material to the tobacco filler is performed in advance of the cigarette-making process.

The applying or precoating step is performed while the tobacco filler is in motion in order to provide a uniform distribution of the adhesive or binder material and adequate moisture control of the tobacco filler. The precoating step may be performed in a tumbling drum or a fluidized bed or on a moving conveyor, all of which are hereafter referred to as providing a moving bed of tobacco filler.

The tobacco shreds are uniformly mixed or coated with a bonding material which, as the term implies, causes bonding of the tobacco shreds under certain conditions. The bonding materials that may be employed in the process of the present invention include those materials which by themselves cause bonding of the tobacco shreds and also include those materials which indirectly cause such bonding by having the effect of releasing naturally occurring bonding agents contained within the tobacco itself which agents subsequently cause the actual bonding of the tobacco shreds.

Bonding materials which by themselves cause bonding of the tobacco shreds include, for example, film-forming materials, cross-linking agents, lipids, waxes and resins. Generally, the types of film-forming materials which may be employed in the present invention include, inter alia, polymers and resins selected from the classes of saccharides, polysaccharides and their derivatives, and synthetic thermoplastic film formers.

Some of the typical saccharides and polysaccharides are: sucrose; dextrose; polydextrose; natural gums such as arabic, guar and locust bean; gums of fermentation such as dextran, xanthan and curdlan; starches; algins, pectins, xanthomonas and their water soluble salts (e.g., sodium, potassium and ammonium salts); chitin; and chitosan and its salts (e.g., acetate and chloride salts). Suitable polysaccharide derivatives include: the cellulose, starch and gum ethers and esters, such as carboxymethyl cellulose, carboxymethyl starch, carboxymethyl guar, carboxymethyl chitin, methyl cellulose, ethyl cellulose, ethyl hydroxyethyl cellulose, hydroxyethyl cellulose, hydroxypropyl cellulose, methyl hydroxypropyl cellulose, hydroxypropyl guar, cellulose acetate and oxycellulose; and other derivatives of starch and gums, such as hydrolyzed starches and dextrins. Typical synthetic film-forming resins include: polyvinyl alcohol; polyvinyl acetate; polyvinyl pyrrolidone; polyacrylic acid; copolymers combining methyl vinyl ether and maleic anhydride and salts of such copolymers; and polyvinyl pyridines. Typical lipids, waxes, resins and similar materials suitable for bonding and generally having a melting point in the range of about 40–120 C. include: the saturated fatty acids having at least 14 carbon atoms and the glycerin and sugar esters of such acids, the fatty alcohols and ketones containing at least 14 carbon atoms, paraffins, beeswax, carbowax, tobacco waxes, tobacco resins and other waxy-type and resin materials.

Bonding materials which cause indirect bonding of the tobacco shreds include: calcium sequestering agents such as diammonium phosphate; lower polyfunctional carboxylic acids such as oxalic, citric, malic, malonic, succinic, and tartaric and their sodium, potassium and ammonium salts; and carbonate, bicarbonate and phosphate salts of sodium and potassium. One or more sequestering agents may be employed at one time either to the entire tobacco filler blend or to a portion therein. When the tobacco filler is treated with a calcium sequestering agent in the presence of a base such as hydroxides of ammonium or potassium or sodium, the tobacco pectin, which is naturally found in its calcium pectate water insoluble form, is released in a soluble form. The released pectin, which is a film-forming material, may then be used as the bonding agent in a manner described in this process or by cross-linking with a polyvalent metal ion or by gelling and drying. The employment of tobacco derived pectins as bonding agents is disclosed, for example, in U.S. Pat. Nos. 3,499,454; 3,420,241; 4,674,519 and 4,341,228.

Suitable cross-linking agents for bonding tobacco shreds in this process are those that were previously disclosed in U.S. Pat. No. 4,341,228.

Where a soluble binder is used, the binder material is dissolved in water or an organic solvent and pumped through a spray nozzle directed at the moving bed. Alternatively, the binder material may be formed into a liquid foam and delivered to the moving bed through a nozzle or orifice. As the foam material will contain less moisture than a spray solution of equivalent volume, the subsequent drying procedure may be simplified.

Where a liquid or foamed binder is used, a treating or drying step is preferably conducted simultaneously with the spraying step by blowing hot air through the tobacco filler in a tumbling drum. By simultaneously drying the tobacco, agglomeration of the coated particles or filaments of the filler material is prevented. Moreover, by drying the coated tobacco filler promptly, the adhesive or binder solids are maintained on the surface of the tobacco and do not have an opportunity to soak excessively into the interior of the tobacco and thus be unavailable for subsequent use as an adhesive or bonding agent.

While it is convenient to use hot air for the drying step, the combustion products of a gas or oil burner or superheated steam may also be utilized separately, or in conjunction with air. It will be appreciated that the drying rate increases with the temperature of the drying media. The upper limit of the temperature of the drying media is determined by the requirement of not degrading the tobacco while the lower limit is determined by such practical considerations as not excessively extending the time required to complete the drying step. In this regard, it is undesirable for an appreciable amount of the adhesive or binder to be permitted to soak below the surface of the tobacco filler since such adhesive or binder material will then become ineffective for subsequent bonding of the tobacco strands or particles. Air temperatures in the range of 140° to 450° F. (about 60°–235° C.) have been found to be satisfactory for drying. After drying, the moisture content of the coated tobacco filler should be in the range of 12–14% OV which is about the same moisture content as exists in the filler prior to coating. During the coating process, the moisture content should be kept below about 20% OV and this is facilitated by performing the drying step simultaneously with the coating step as indicated above.

While the coating and treating or drying steps are preferably performed in a continuous operation, a batch operation is possible if the coating is applied in a tumbling drum such as a commercial clothes dryer which permits simultaneous drying. Using such equipment it is possible to apply pectin as a binder in the form of a 2% water solution to attain a level of about 6% in a 30 pound batch of the coated filler in a period of about 95 minutes. During this period, about 97 pounds of the binder solution are sprayed in the tumbling batch of filler.

As an alternative to the spraying and drying of a binder solution on the filler tobacco, a dry powdered binder such as fine powdered dextran may be dusted on the tobacco filler after the moisture content has been raised to a level of about 20% OV. In this instance, unless the filler tobacco is subsequently dried, the filler tobacco containing the binder in powder form should immediately be passed through the cigarette maker as the dry binder will become activated by the excess moisture in the tobacco filler.

Another alternative to the spray coating step is to form thermally gelled sheets from a material such as methocel (Dow Chemical Company's Methocel A4C), shred the gelled sheets while they are still warm, blend the shredded thermally gelled sheets with hot tobacco filler and form the resulting blend into a tobacco rod. Upon cooling the tobacco rod, the thermally gelled shreds liquify and, upon drying, a bond is formed wherever the liquid material contacts adjacent tobacco particles.

Following the application and treating or drying steps, the coated filler may be stored for subsequent use or directed to the hopper of the cigarette maker. In the hopper/ecreteur section of the cigarette maker, a tobacco carpet is formed on a conventional suction tape and then trimmed to the desired height in the ecreteur.

The tobacco carpet is thereafter formed into a tobacco rod of roughly circular cross-section in the garniture portion of the maker in preparation for the activation step of the present process. Normally, the tobacco rod is formed in the garniture of the maker on a nonporous belt which also carries the cigarette paper. However, to facilitate the practice of the present invention, it is preferred to form the tobacco rod on a porous belt without the use of cigarette paper. The cylindrical tobacco rod, while still contained by the porous belt, may be exposed to a stream of wet steam or moisturized air, a water spray or a solvent which activates the preapplied binder coating contained on the surface of the tobacco filler. The binder may, in appropriate cases, be activated by electromagnetic energy such as microwave, ultrasonic or infrared radiation or by a process of polymerization. The activated binder thereupon bonds the shreds or particles of tobacco at points within the tobacco rod.

To insure prompt curing of the binder, the bonded tobacco rod may sequentially be passed through a drying step and a vapor removal and cooling step. The drying step preferably is performed in a microwave dryer and the vapor removal and cooling step may use a stream of air or a vacuum operation. Upon leaving the vapor removal and cooling step the moisture content and temperature of the tobacco rod should be compatible with the requirements for wrapping and sealing the tobacco rod with cigarette paper, cutting the rod to form cut rods and collecting the cut rods.

It will be appreciated that the precise nature of the activation step will depend upon the nature of the binder which has been preapplied to the filler tobacco. If the binder is water soluble, water or wet steam may be used as the activating agent. If the binder is a low melting point substance such as tobacco wax and resins, myristic acid, myristic alcohol, etc., steam or heat may be used to activate the binder. In some cases an organic solvent may be required for a binder soluble in such a solvent.

As a result of the bonds formed between contacting tobacco strands or shreds, the tobacco rod and the resulting finished cigarette are firmer than the rod or cigarette would be without the adhesive bonding. Moreover, there is a reduced tendency for shreds of tobacco filler to fall from the end of the finished cigarette since bonding of the tobacco shreds extends substantially across the cross-section of the tobacco rod.

Figure 2:
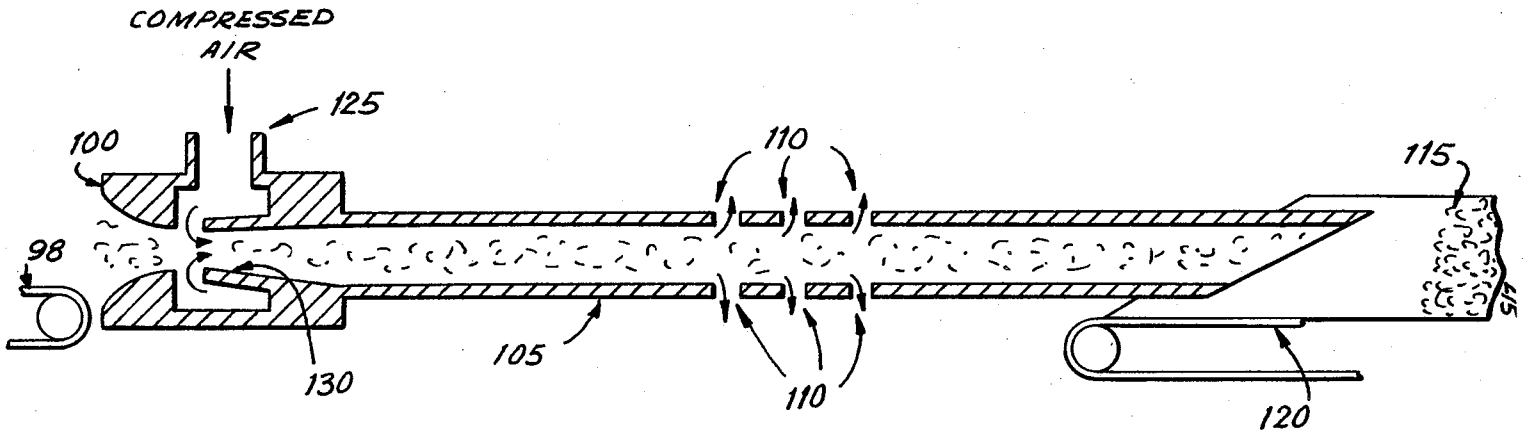
FIG. 2 is an elevation showing the apparatus for a pneumatic process of rod formation.

The high void volume/enhanced firmness cigarette of the present invention may also be formed using other methods and apparatus, including, but not limited to, the pneumatic and steam/pneumatic methods described below. The pneumatic method, illustrated in FIG. 2, is as follows: The binder is applied to tobacco filler as in the method described above. The treated tobacco shreds are metered onto a moving tape 98 which leads into an orifice 100 which entrains the shreds in an air stream in tube 105 causing the shreds to gain momentum. The air stream is then exhausted through vents 110 in tube 105 causing the shreds to continue traveling on their own momentum until the shreds are collected into a loosely packed rod 115 within a continuously moving circular porous garniture tape 120. The driving force for the air stream may be obtained by using a vacuum unit around the vents 110, or by using an aspirating unit 125 at the inlet 130 of the tube, or by a combination of these methods. Control of the feed rate and the air stream velocity allow the density of the exiting tobacco rod to be regulated.

The binder is activated as in the method described above. Likewise the tobacco rod is dried, and wrapped as in the method described above.

Figure 3:
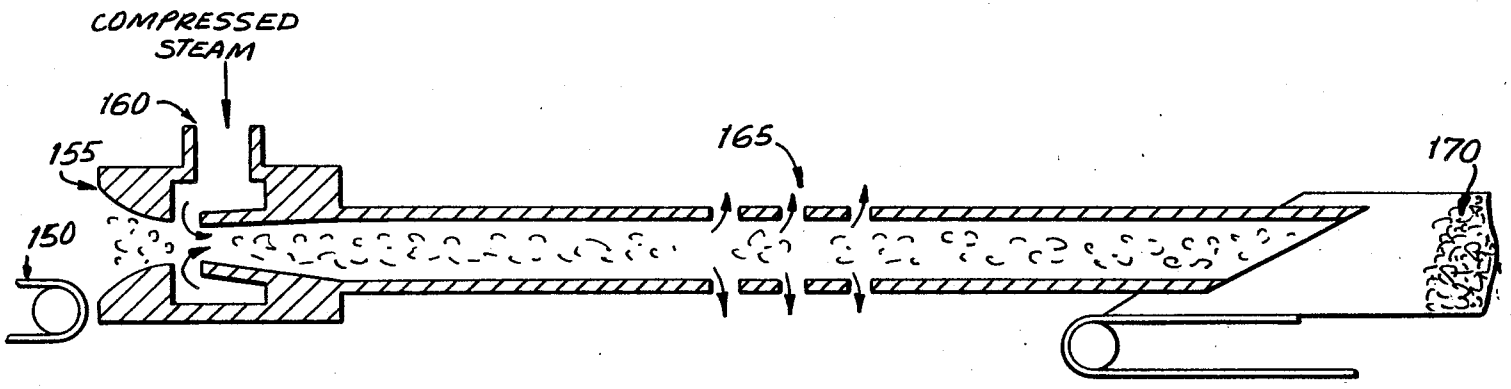
FIG. 3 is an elevation showing the apparatus for a steam/pneumatic rod formation process.

FIG. 3 shows an alternative method of forming the tobacco rod using a steam/pneumatic method as follows: a water or heat activated binder is applied to tobacco filler as in the methods described above. The tobacco shreds coated with binder are metered onto a moving tape 150 which leads into an orifice 155 which entrains the shreds in a steam stream. The shreds are then accelerated by an aspirator 160 to the garniture 165 of an otherwise conventional cigarette maker where the steam stream is removed causing the shreds to continue traveling on their own momentum. The shreds may then be collected to form a tobacco rod 170. The binder is activated by steam condensate which quickly and uniformly deposits moisture on the surfaces of the shreds while the tobacco shreds are entrained in the steam stream. The increased temperature of the steam condensate reduces the amount of water needed for activation where a water soluble binder is used; as a result, the binder is activated quickly and the moisture content gain of the filler during activation is minimized. The binder in the formed tobacco rod is dried as in the methods described above, causing the binder to set at contact points forming the high void volume/enhanced firmness tobacco rod. Control of the feed rate and steam stream pressure allows control of the density of the resulting tobacco rod. The tobacco rod is then wrapped, preferably by cigarette paper, and is dried to form the cigarette of the present invention.

The tobacco rod with activated binder formed by either the preferred, pneumatic or steam/pneumatic method may alternatively be dried and cooled by passing through a garniture section where air is introduced as a means of cooling and partially drying the bound rod. Microwave or other methods of drying may also be used. The amount of air applied varies depending upon the density of the tobacco rod being produced. The tobacco rod is then allowed to dry in ambient air with or without the application of heat. When dried, the shreds are locked into place forming a rigid cylindrical structure.

These methods alternatively may incorporate application of suction to the tobacco rod in the garniture section where air is introduced to cool and dry the rod. The suction produces a drier and cooler tobacco rod by removing vaporized water.

Figure 4:
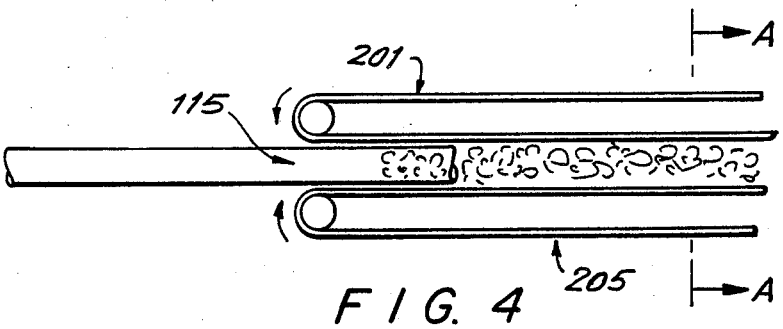
FIG. 4 is an elevation showing a dual tube belt rod formation apparatus.
Figure 5:
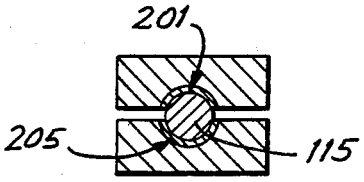
FIG. 5 is a cross-section of the dual tube belt apparatus of FIG. 4.

The pneumatic or steam/pneumatic method also may alternatively incorporate a dual tube belt within the steaming/drying garniture (FIGS. 4 and 5). This has the advantage of allowing shred orientation in the tobacco rod to be varied by varying the speed differential of the two tube belts 201, 205.

Figure 6:
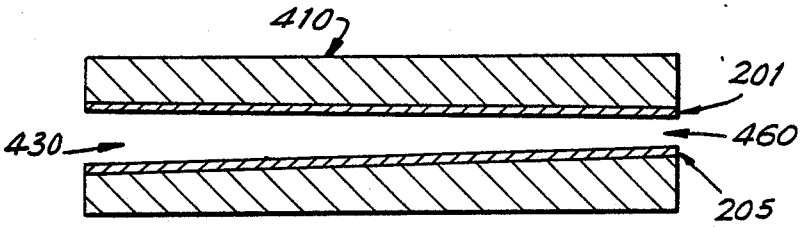
FIG. 6 is an elevation showing a tapered garniture section.

In addition, the pneumatic or steam/pneumatic methods may alternatively provide for the tobacco rod to be formed within a tapered section 410 of the garniture going from a wide section 430 to a narrow section 460. (FIG. 6). This has the advantage of increasing the amount of feed rate variation that can be accommodated, while maintaining constant rod density.

The pneumatic and steam/pneumatic methods have the advantage of orienting the individual shreds of the tobacco rod in a generally radial direction. This increased radial shred orientation causes greater resistance to radial compression which is an indicator of increased firmness.

Figure 7:
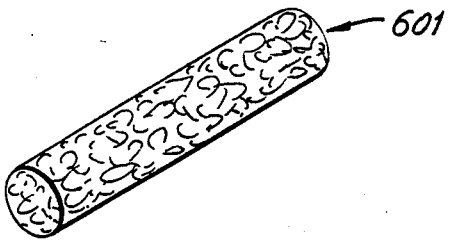
FIG. 7 is a perspective view of a cylindrical rod formed either by the pneumatic or steam/pneumatic process.
Figure 8:
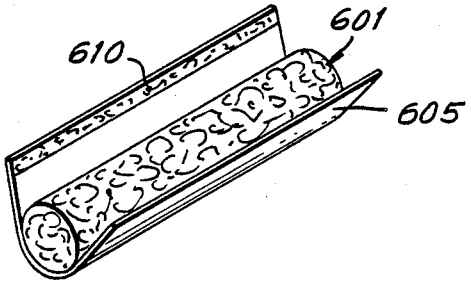
FIG. 8 is a perspective view of a cigarette paper being wrapped around said rod of FIG. 7.
Figure 9:
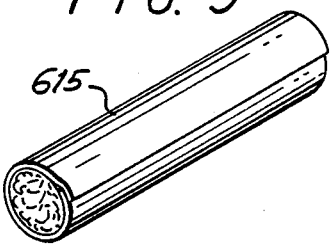
FIG. 9 is a perspective view of a wrapped cigarette.

When a rod has been formed either by the preferred method, pneumatic method or by the steam/ pneumatic method and the binder has been set by drying, a tobacco rod 601 as shown in FIG. 7 results. This rod 601 may be wrapped by paper 605, as shown in FIG. 8. Paper 605 is secured around the rod 601 by a glue strip 610 to form a cigarette 615 as shown in FIG. 9. Alternatively, the rod can be wrapped during formation provided that the paper used will not become discolored or otherwise marred or damaged as moisture is driven off in the drying process.

The following examples illustrate the manner in which various binders may be applied to tobacco filler and subsequently activated in accordance with the method of the present invention. Tobacco filler so treated may be used to produce cigarettes having a higher void volume for a given firmness.

EXAMPLE 1

One pound (DWB) samples of tobacco filler blend having OVs of 14, 18, 23 and 30% were placed into a revolving bowl-shaped tumbler, having an 18-inch center diameter and three one-inch deep flights located 60° apart in the inside surface along the rotating axis of the bowl. The bowl-shaped tumbler was rotated at 33 rpm. While the tobacco filler was being tumbled and mixed 10, 20 and 40 g of finer than 60 mesh citrus pectin powder for each pound sample was sprayed onto the tumbled tobacco filler and mixed therein. Each coated sample was divided into three equal parts. One of the samples was taken off the tumbler and was put in sealed glass jars and allowed to equilibrate for 24 hours and then allowed to air dry. The second sample was spread on aluminum foil and allowed to air dry at laboratory conditions to 12% OV. The third sample was left in the tumbler and while it was being tumbled, the coated tobacco filler was steamed for 30 seconds and then it was divided into two equal parts. One of these samples was spread on aluminum foil and air dried at laboratory conditions to 12% OV and the second sample was put in sealed glass jars for 24 hours and then it was air dried as above to 12% OV.

Results

The tobacco filler samples of 14, 18, 23 and 30% OV coated with 10, 20 and 40 g of powdered pectin and then air dried at laboratory conditions to 12% OV were found to contain a whitish coating on their surface which was more pronounced in the lower OV samples coated with the higher amounts of pectin powder. Upon shaking the 12% OV samples in a sieve shaker for five minutes, it was noticed that some of the coating was dusted off the samples. However, the samples that were allowed to equilibrate in sealed jars for 24 hours prior to air drying at laboratory conditions to 12% OV appeared to have a much lesser amount of visible coating on the tobacco filler surface and retained the coating better than the previous samples when treated in the shaker under similar conditions. Finally, the samples that were steamed following the powder coating application and then were air dried or equilibrated in sealed jars and then air dried to 12% OV at laboratory conditions did not appear to contain any visible powderish coating but instead they appeared to have a thin, filmy and glossy surface, especially the samples with 40 g pectin. Shaking of these samples in a sieve shaker did not cause any noticeable amount of the coating to dust off the samples.

EXAMPLE 2

The conditions of Example 1 were repeated with the use of finer than 60 mesh powders of gum arabic, sodium CMC, sodium alginate, dextran, pregelatinized starch, amylo pectin and hydroxypropyl methyl cellulose in place of the powdered pectin. In these cases, similar results as those with pectin in Example 1 were obtained.

EXAMPLE 3

Portions of the tobacco filler samples of Examples 1 and 2 were humidified with steam or with a fine water mist spray or with liquid foam water (water with 1% foaming agent) to 24 and 35% OV. Samples of these treated tobaccos fillers were then made into cigarettes with the use of a RYO Filtermatic cigarette maker (U.S. Pat. No. 3,515,147) and dried in an air circulating oven at 100° C.

Results

The tobacco filler in all the hand-rolled cigarettes was well adhered in an open mesh structure. The produced cigarettes were found to be strong and self-supported (i.e., did not come apart when holding from one end). However, the more weakly bound cigarettes were those that contained the lowest amount of adhesive.

EXAMPLE 4

The conditions of the previous examples were repeated with the use of 10% (w/w) of corn syrup or maltodextrin having a DE 10 and 35, or glycerine in the powdered binder (adhesive). In these cases, it appeared that the additives facilitated the activation of the various binders as judged by the degree of tackiness during the activation by steam or water.

EXAMPLE 5

The conditions of Examples 1 and 3 were repeated with the use of methyl cellulose and dextran. The binders in this case were activated with ethanol to produce well-adhered and self-supported hand-rolled cigarettes as in Example 3.

EXAMPLE 6

One pound (DWB) samples of tobacco filler blend at 16% OV were coated with (40 g each) finer than 60 mesh paraffin wax or myristic acid or myristic alcohol or tripalmitin or polyox powders having melting points in the range of 38° C.-66° C. The coating operation was carried out in a hot air atmosphere (70° C.) with the use of the previously described tumbler. The coated tobacco filler samples were then equilibrated to 12% OV and were formed either into hand-rolled cigarettes (paper wrapped tobacco rods) or into ½-inch thick mats. Activation of these bonding agents was then achieved with heat (steam or hot air). In the case of the mats, the steam or hot air from a hair dryer was forced through the mat by the application of 26-inch vacuum from below. Both samples, the mat and the tobacco rods with the removed wrapper, were found to be bonded and self-supported. The waxy materials appeared to accumulate at the tobacco filler shred crossings and encase that portion of the tobacco filler within the formed waxy droplet.

EXAMPLE 7

The conditions of Example 1 were repeated with 23% OV tobacco filler and 30 g sodium pectate or sodium alginate powders per pound of tobacco filler blend (DWB). The powder coated tobacco filler samples were then steam conditioned and allowed to dry at room conditions in a dispersed (loose) state to 12% OV. Portions of these tobacco filler samples were formed into ½-inch thick mats in a pan having a metallic screen bottom (10 mesh), and placed over a vacuum chamber where vacuum was applied from below to facilitate the activation of the binders (adhesives) with various impregnants.

The binder in some of the samples was activated by wetting the tobacco filler to 30% OV, and in others with a foamed 10% CaCl water solution to 30% OV. At the end of each treatment, portions of the mats were dried with hot air (60° C.) and others were made into hand-rolled tobacco rods and then dried at 100° C. in an air circulated oven.

Results

In all cases, the binders were activated and caused the tobacco shreds to adhere to each other to form cohesive, self-supported structures. In the case where CaCl was used, the formed mats and tobacco rods were found to be firmer and less sensitive to moisture. The polyvalent metal ion or calcium in this case cross-linked with carboxylic acid groups of these polysaccharides to form a water insoluble binder.

EXAMPLE 8

One pound (DWB) samples of tobacco filler blend were coated with 6% (DWB) methocel (Dow Chemical Co.'s Methocel A4C). The tobacco filler, 12% OV, in this case was put in a tumbler and heated with 80° C. air or with steam and, while hot, it was sprayed with a 2% methocel solids water solution. The methocel solution droplets upon coming in contact with the hot tobacco filler were caused to thermally gel on the tobacco surface thus preventing the tobacco shreds from sticking to the equipment and to each other. Portions of the hot tobacco filler were formed into ½ inch thick mats or hand-rolled into cigarettes. These structures were then allowed to cool to room temperature which was below the thermogelation temperature of the methocel solution. Other portions of the coated tobacco filler were allowed to dry with hot air to 12% OV and then formed into similar structures as above. Portions of the mats made with the 12% OV precoated tobacco filler were humidified to 30% OV with steam or with foamed water and then rolled into cigarettes at ambient conditions and then dried in an 100° C. forced air oven.

Results

The tobacco mats and hand-rolled cigarettes made with the coated, hot tobacco filler samples that were still wet, and then allowed to cool were found to be adhered, and maintain their integrity when they were dried in an 100° C. forced air oven. The adhesion of the two structures was enhanced by the application of pressure (weight) prior to drying, whereas the samples made with the precoated and dried tobacco to 12% OV did not form an adhered structure even when the tobacco filler was compressed. However, the samples that contained the rehumidified precoated/dried tobacco filler behaved similarly to the first set of samples.

Activation of the adhesive in this case was achieved with moisture and temperature control.

EXAMPLE 9

The following sheets (films) were made by coating 8% solutions of pectin, CMC, dextran, dextrin and gum arabic and then drying on stainless steel plates. The sheets were 4 mils thick. These were then shredded into 32 cpi and blended with a cut tobacco filler blend at 5 and 10% w/w levels in the blend at 12% OV.

The blended fillers were then humidified to about 30% OV with water (spray) or with steam, and were made into hand-rolled cigarettes with the use of a RYO Filtermatic cigarette maker. Portions of the humidified blended fillers were made into ½-inch thick webs and dried under a small amount of pressure (weight).

EXAMPLE 10

The conditions of Example 7 were repeated with the addition of 10% (DWB) tobacco water soluble solids in the binder solution prior to coating.

Results

In all cases (Examples 9 and 10) the tobacco filler shreds were well adhered to each other forming a self-supported open structure. The greater degree of adhesion was achieved with the 10% binder filler solids in the blend but indications were that the samples containing the 5% binder filler solids would be sufficient for this purpose by shredding the sheets into finer shreds (>60 cuts/inch) to cover a wider area in the blend. The binder containing the tobacco solubles appeared to be tackier and more hydrophilic than the formulations that did not contain such additives.

EXAMPLE 11

A 4% solids methocel solution in water was made and foamed with air. It was then cast onto stainless steel plates and thermally set by heating the foamed cast sheet to a temperature above the methocel gelation point. The thermally gelled sheets were removed from the plates, shredded while still warm and gelled, and then blended with hot tobacco filler. The amount of methocel gelled solution added was calculated to yield 5% and 10% methocel solids (DWB) on the weight of tobacco filler (DWB). The produced blends were used to fabricate hand-rolled tobacco rods and ½-inch thick mats on a 10 mesh screen placed over a vacuum box. The samples were then allowed to cool and then dried in an air circulating oven at 100° C.

Results

The gelled methocel solution strands liquified upon cooling causing the tobacco shreds to be wetted and adhered to each other in a strongly bound self-supported structure when dried.

EXAMPLE 12

Three 100 g portions of 12% OV tobacco filler blend were placed separately in a rotating basket centrifuge (Pfeiser Scientific Catalog Number 71-8115 equipped with a 5-inch diameter perforated basket rotor, Catalog Number 71-8105, having a capacity of 0.3 liters) at 1000, 2000, and 3200 rpm respectively. The tobacco filler in each case was fed to the center of the rotating basket and forced to mat against the peripheral wall of the perforated basket rotor. This was then followed with the addition of 20 g of a liquid foam binder having a foam density of 0.08 g/cc and a solids content of 10%. The liquid foam was added at a rate of 2 g per second to the center of the rotating basket. At the end of the liquid foam addition, the samples were allowed to spin for an additional 5 seconds. In each case, several tobacco filler samples were taken from various positions along the inner and outer surface of the matted tobacco filler and from within the mat depth.

Results

All the tobacco filler samples were found to be uniformly wetted and cased with the liquid foam binder, and that there was no significant difference in casing level between the inner and outer mat surfaces. Also, the surfaces of the basket appeared to be clean and free of any binder buildup.

Visual examination of the process of adding the liquid foam to the tobacco filler in the centrifuge revealed that the injected foam was forced to the basket periphery by the centrifugal force and that upon coming in contact with the matted tobacco filler, the liquid foam instantaneously penetrated the tobacco filler mat and dissipated therein.

EXAMPLE 13

The conditions of Example 12 were repeated at 3200 rpm and 20 g of liquid foam per 100 g portions of 12% OV tobacco filler blend samples. The liquid foam in each case contained 10%, 30%, and 50% solids and foam densities of 0.08, 0.12, and 0.22 g/cc, respectively. The rate of adding foam was maintained at 2 g/second.

In each case, the coated samples with liquid foam binder were compared to each other and to the controls treated with steam and with foamed (1% foaming agent) or unfoamed (zero solids) liquids.

Using this system, the following treatments (A, B, and C) were carried out:

Treatment A

1. Two 100 g portions of 12% OV tobacco filler blend were steamed to 20 and 30% OV in the basket centrifuge.
2. Three 100 g portions of 12% OV tobacco filler blend were cased with 10, 14, and 18 g of unfoamed liquid containing no solids.
3. Three 100 g portions of 12% OV tobacco filler blend were cased with 10, 14, and 18 g of foamed liquid having 0.08 g/cc foam density and 1% foaming agent (no binder).
4. A 100 g portion of the same tobacco filler blend was cased with 20 g of liquid foam binder having a foam density of 0.08 g/cc and 10% solids.
5. A 100 g portion of the same tobacco filler blend was cased with 20 g of liquid foam binder having a foam density of 0.12 g/cc and 30% solids.
6. A 100 g portion of the same tobacco filler blend was cased with 20 g of liquid foam binder having a foam density of 0.22 g/cc and 50% solids.

Treatment B

The Treatment A was repeated but at the end and while the treated tobacco filler samples were centrifuged, the samples were dried to 8–12% OV with hot air (140°–180° F.)

Treatment C

The samples 4, 5, and 6 of Treatment A were repeated. Each of these samples at the end of Treatment A was dispersed into a hot (350° F.) air stream and dried to 8–12% OV. The samples were conditioned to 12% OV and reinserted into the spinning basket centrifuge at 3200 rpm. These were then treated with steam or liquid (foamed/unfoamed) as per steps 1, 2, and 3 of Treatment A and finally dried as per Treatment B.

Results

Treatment A

All samples of this treatment, with the exception of number 2, yielded uniformly wetted/cased products. The samples 5 and 6 were somewhat tacky but still very loosely held together and easy to separate. Samples 2 were spotty, nonuniformly wetted, and some of the liquid was extracted by centrifuge.

Treatment B

The samples treated with steam or with liquid (foamed/unfoamed) were very loose and the tobacco filler shreds did not adhere to each other. However, the tobacco filler samples cased with the foamed liquid binder were found to be uniformly adhered together into an open mesh self-supported web. There did not appear to be any significant difference in adherence between the top and bottom side (inner/outer surface) of matted tobacco filler, and very little difference between the samples cased with the different foam densities.

Treatment C

All the precoated samples with the 10, 30, and 50% solids binders were found to be uniformly adhered together in a self-supported mat when the preapplied binder was activated with steam and with the foamed liquid. The greater degree of tobacco filler shred adhesion in these samples was achieved in the precoated samples with 30 and 50% solids finders. The activation of the binder with unfoamed liquid produced variable results, especially in the case where lower amounts of liquid were used. In these cases, segments of the samples treated with the unfoamed liquid for activation of the binder in the precoated tobaccos were found to be adhered and others were not. When the liquid was added in atomized form using an ultrasonic nozzle, the adhesive was activated and caused a uniform adhesion between the tobacco filler shreds to form a strong, self-supported tobacco mat.

EXAMPLE 14

A mat of 12% OV tobacco filler blend, ½-inch thick, was formed in a rectangular pan having a 40 mesh wire screen bottom. The upper surface of this mat was uniformly coated with a liquid foam binder having 10% solids and a foam density of 0.08 g/cc. The amount of liquid foam binder used was equivalent to 20 g foam/100 g 12% OV tobacco filler. The rectangular pan containing the tobacco filler mat with the liquid foam binder on its upper surface was then placed over a vacuum box where 26 inches of vacuum was applied from below. The vacuum forced the liquid foam to be sucked (penetrated) into the tobacco filler mat and coat the tobacco filler. Half of the mat was dispersed with a wire brush into a hot air stream (350° F.) and dried to 8–12% OV and the remaining portion of the undisturbed coated mat was dried in place with 140° F. air. The dispersed/dried precoated tobacco filler was reformed into a mat, steamed to 30–35% OV and then dried with 140° F. air under a 10-inch vacuum.

Results

The dried in place mat that was coated with the liquid foam binder was found to be well adhered and self-supported. The reformed mat with the precoated binder which was steamed and then dried was also adhered together and was self-supported.

EXAMPLE 15

The experiment was repeated by applying ½ of the liquid foam in the manner previously described in Example 14 and the other ½ of the liquid foam binder was applied in a second step without vacuum but with the use of a squeegeeing apparatus.

Results

A sample of the mat coated under vacuum with ½ the amount of liquid foam binder and dried undisturbed was found to be very weakly adhered together whereas the mat impregnated with the two-step approach was found to be more strongly bound and self-supported. The mats made with the precoated/dried tobacco filler in which the binder was activated with steam and then dried under a 10-inch vacuum produced similar results.

EXAMPLE 16

Example 15 was repeated but without the use of vacuum for the impregnation of the tobacco filler mat with the liquid foam binder. Instead, the applied liquid foam binder was added to the top surface of the tobacco filler mat and then was squeezed into the mat.

Results

This method of coating tobacco filler with liquid foam binder was also found to be satisfactory by a similar testing as for Example 15.

Thus it is seen that a cigarette is provided having higher void volume for a given firmness. Also, a method is provided for treating tobacco filler so as to produce such cigarettes. One skilled in the art will appreciate that the present invention can be practiced by other than the preferred embodiments which are presented for purposes of illustration and not of limitation, and the present invention is limited only by the claims which follow.

What is claimed is:

1. A tobacco product comprising a tobacco rod, a wrapper around the rod, the rod having a plurality of tobacco shreds, with adjoining shreds being adhered to one another by binder leaving flow passageways within the rod, the wrapped rod being further characterized by a firmness and a void volume such that the void volume (%) is greater than a value represented by: ten times the firmness (mm), plus 108.4 mm, all divided by 2.2 mm.

2. The product of claim 1 in which the rod is structurally self-supporting without the aid of wrapping paper or other covering.

3. The product of claim 1 in which the void volume of the rod is greater than 68%.

4. The product of claim 1 further characterized by a firmness and a void volume such that the void volume is greater than a value represented by: ten times the firmness, plus 123.2 mm, all divided by 2.2 mm.

5. The product of claim 4 in which the rod is structurally self-supporting without the aid of wrapping paper or other covering.

6. The product of claim 5 in which the void volume of the rod is greater than 68%.

7. The product of claim 6 in which the void volume of the rod is greater than 72%.

8. The product of claim 1 or 4, in which the tobacco shreds are distributed within the rod in a generally radial orientation.

9. The product of claim 1 or 4 in which the tobacco rod has an encapsulated resistance to draw not in excess of a value equivalent to two inches of water when the rod is wrapped in a wrapper impervious to air.

10. A method of making a tobacco product, comprising the steps of:

applying a binder to tobacco filler;

treating the filler shreds to the extent necessary to cause the binder to become substantially non-tacky;

forming the treated filler shreds into a rod;

activating the binder, thus causing the filler shreds to adhere together; and treating the rod to the extent necessary to cause the filler shreds to become bonded to one another.

11. The method of making a tobacco product set forth in claim 10 wherein after the filler is treated so that the binder becomes substantially non-tacky, the filler is entrained in an air stream whereby the filler gains momentum and then the air stream is exhausted and the filler travels on its own momentum until the filler is collected into a rod.

12. The method of making a tobacco product in a cigarette making machine having an entraining while entrained in the airstream and while traveling on its own momentum flows through the tube on the way to the rod forming apparatus in order to affect the orientation of the shreds.

13. A method of making a tobacco product in a cigarette making machine having a garniture section comprising the steps set forth in claim 10 or 13 wherein said rod treating step comprises running the rod through a garniture section where air is introduced to cool and dry the rod to the desired moisture level.

14. A method of making a tobacco product in a cigarette making machine having dual tube belts comprising the steps set forth in claim 10 or 19 wherein said rod forming step comprises varying the speed of the tube belts to control shred orientation in the rod.

15. A method of making a tobacco product in a cigarette making machine having a tapered garniture section comprising the steps set forth in claim 10 or 14 wherein said rod forming step comprises collecting the shreds into a rod within the tapered garniture section.

16. The method of making a tobacco product in a cigarette making machine having a porous tube belt in a tapered garniture section comprising the steps set forth in claim 10 or 14 wherein said rod forming step comprises forming the filler into a rod within the porous tube belt.

17. The method of making a tobacco product set forth in claim 10 or 14 wherein said rod treating step is partially or completely performed by exposing the rod to microwave energy.

18. The method of making a tobacco product set forth in claim 10 or 14 wherein said steps of applying binder and treating the filler occur simultaneously.

19. A method of making a tobacco product comprising the steps of:

applying a water soluble or heat activated binder to tobacco filler;

treating the filler to the extent necessary to cause the binder to become substantially non-tacky;

entraining the treated filler in a steam stream, thereby causing the binder to become activated;

conveying the entrained filler to the garniture of a cigarette maker where the steam stream is removed;

forming the filler shreds into a rod; and treating the rod to the extent necessary to cause the shreds to become bonded to one another.

20. The method of making a tobacco product set forth in claim 13 further comprising regulating the density of the exiting rod by controlling the feed rate and steam stream pressure.

21. A method for treating tobacco filler comprising the steps of:

applying a binder to a moving bed of tobacco filler;

treating the filler containing the binder to the extent necessary to cause the binder to become substantially non-tacky;

providing a metered supply of substantially non-tacky tobacco filler containing the binder material;

forming the metered supply of substantially non-tacky tobacco filler containing the binder material into a tobacco rod; and activating the binder to produce a tobacco rod having a plurality of tobacco shreds, with adjoining shreds being adhered to one another by a binder leaving flow passageways within the rod.

22. A method as set forth in claim 21 wherein the binder is applied as a liquid.

23. A method as set forth in claim 21 wherein the binder is a dry powder.

24. A method as set forth in claim 21 wherein the binder is a low melting point solid in the form of a powder finer than 60 mesh.

25. A method as set forth in claim 21 wherein the binder is a thermogelling material having a thermogelation temperature above room temperature.

26. A method as set forth in claim 25 wherein the step of forming the filler tobacco containing the thermogelling binder into a cigarette rod is performed at a temperature above the thermogelation temperature and the activation step is performed by cooling the tobacco rod below the thermogelation temperature.

27. A method as set forth in claim 26 wherein boding is effected by drying the tobacco rod.

28. A method as set forth in claim 27 wherein the drying step utilizes microwave energy.

29. A method as set forth in claim 21 wherein the binder is film-forming material, a cross-linking agent or a combination thereof.

30. A method as set forth in claim 29 wherein the binder is a film-forming material and the film-forming material is formed into a sheet, shredded and then mixed with the tobacco filler.

31. The method of claim 21 wherein the moving bed of tobacco filler is generated by tumbling th tobacco filler in a tumbling drum.

32. The method of claim 21 wherein the moving bed of tobacco filler is a fluidized bed.

33. The method of claim 21 wherein the binder is in liquid form; the step of treating the filler shreds comprises drying the filler shreds; and, the treating the filler step is performed simultaneously with the application of the binder.

34. The method of claims 21 wherein the binder is in liquid form; the treating the filler shreds step comprises drying the filler shreds; and, the steps of applying the binder and treating the filler are performed simultaneously in a tumbling drum.

35. A method as set forth in claim 21 wherein the activating agent is selected from the group consisting of steam, moisturized air, water, hot air, organic solvents, electromagnetic radiation, and ultrasonic energy.

36. A method as set forth in claim 21 wherein the activating agent is steam.

37. A method as set forth in claim 21 and comprising the additional step of drying the tobacco rod formed from activated binder and tobacco filler.

38. A method as set forth in claim 21 wherein the binder is applied as a foamed liquid.

* * * * *